US005174833A

United States Patent [19]

Tanaka et al.

[11] Patent Number: 5,174,833

[45] Date of Patent: Dec. 29, 1992

[54] PRODUCTION OF GRAIN-ORIENTED SILICON STEEL SHEETS HAVING AN INSULATING FILM FORMED THEREON

[75] Inventors: Osamu Tanaka; Eisuke Minematsu; Norikazu Fujii, all of Kitakyusyushi; Kikuji Hirose, Okayamaken, all of Japan

[73] Assignee: Nippon Steel Corporation, Tokyo, Japan

[21] Appl. No.: 546,908

[22] Filed: Jul. 2, 1990

[30] Foreign Application Priority Data

Jul. 5, 1989 [JP] Japan ..... 1-173180
Dec. 30, 1989 [JP] Japan ..... 1-344744

[51] Int. Cl.[5] ..... H01F 1/04
[52] U.S. Cl. ..... 148/113; 427/127
[58] Field of Search ..... 148/113; 427/127

[56] References Cited

U.S. PATENT DOCUMENTS 3,996,073 12/1976 Evans ..... 148/113
4,347,085 8/1985 Haselkorn et al. ..... 148/113

FOREIGN PATENT DOCUMENTS 47-7602 3/1972 Japan ..... 427/127

OTHER PUBLICATIONS

Handbook of Chemistry and Physics 60th ed. 1979 p. F-97.

*Primary Examiner*—John P. Sheehan
*Attorney, Agent, or Firm*—Wenderoth, Lind & Ponack

[57] ABSTRACT

A method for forming an insulating film on a grain-oriented silicon steel sheet by applying an insulating coating solution comprising 100 parts by weight (calculated as the solid component) of a mixture of colloidal substances, composed of 50 to 98 weight % (calculated as the solid component $SiO_2$) of colloidal silica having a partical diameter not larger than 50 nano m, and 2 to 50 weight % (calculated as the solid component) of at least one colloidal substance having a particle diameter randing from 80 to 3000 nano m, selected from the group consisting of oxides, carbides, nitrides, sulfides, borides, hydroxides, silicates, carbonates, borates, sulfates, nitrates and chlorides of Fe, Ca, Ba, Zn, Al, Ni, Sn Cu, Cr, Cd, Nd, Mn, Mo, Si, Ti, W, Bi, Sr, and V, 130 to 250 parts by weight of at least one selected from the group consisting of phosphates of Al, Mg, Ca, and Zn, and 10 to 40 parts by weight of at least one selected from the group consisting of chromic anhydride, chromate, and dichromate.

The insulating coating produces good surface film lubricity and good heat resistance and excellent workability when fabricating into a wound core as well as excellent iron loss properties.

2 Claims, 3 Drawing Sheets

SURFACE ROUGHNESS AND LUBRICITY (METHOD B)

FIG. 1
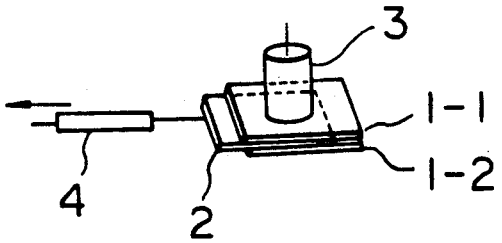
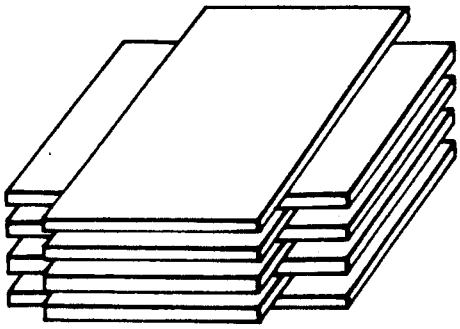
FIG.2(a)
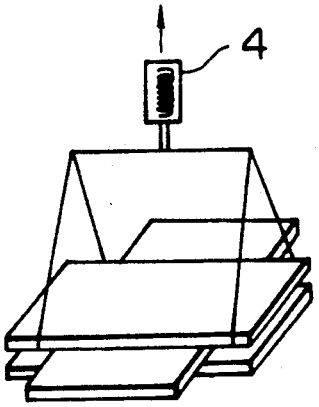
FIG.2(b)

SURFACE ROUGHNESS AND LUBRICITY (METHOD B)

PRODUCTION OF GRAIN-ORIENTED SILICON STEEL SHEETS HAVING AN INSULATING FILM FORMED THEREON

FIELD OF THE INVENTION AND RELATED ART STATEMENT

This invention relates to the production of a grain-oriented silicon steel and more particularly relates to a method for forming an insulating surface film on the grain-oriented steel sheet, which provides good lubricity and heat resistance, and improves workability for fabricating into a wound core for the production of core as well as magnetic property of core.

The production of grain-oriented silicon steels has conventionally been practiced by a process comprising hot rolling a silicon steel slab containing, for example, 2 to 4% Si, annealing the hot rolled sheet, cold rolling the annealed sheet one time or two times with an intermediate annealing performed therebetween to the final gauge, subjecting the sheet to a decarburization annealing, applying on the sheet an annealing separator composed mainly of MgO, subjecting the sheet to a final finishing annealing to develop secondary recrystallization grains having the Goss orientation, removing impurities such as S and N, forming a glassy film on the sheet, applying an insulating coating solution and finally baking the sheet to obtain a final product.

The grain-oriented silicon steel sheets thus obtained are used as material for iron cores used mainly in electric appliances and transformers which require a high magnetic flux density and a low iron loss.

For the production of the iron cores for transformers from the grain-oriented silicon steel sheet, the silicon steel sheet in the form of a hoop is sheared into a predetermined length, and wound or laminated by a iron core machine into a wound core or laminated iron core. In the case of the wound core, after compression forming and stress-relief annealing, a winding operation, called "lacing" is performed to make a transformer.

In the production process of iron cores mentioned above, for example, in the case of the wound core, it is required that the winding and forming must be performed smoothly, that there is caused no surface unevenness on edge surfaces or lap portions of the sheet after the forming and the shape is excellent, and that the sheet surface gives good lubricity.

Also from the points of improving the wound core fabricating efficiency and preventing the development of strain and deterioration of the film quality which are often caused by the baking, it is important that adhesion is caused between surface films of the sheets during the stress-relief annealing and that the lacing operation can be performed smoothly. And since these problems are greatly influenced by the quality of the insulating film formed on the surface of the grain-oriented silicon steel sheet, strong demands have been hitherto been made from the points not only of improving the workability for winding into a core but also of improving the magnetic characteristics of transformers, for the development of insulating surface films which are not susceptible to the adhesion on inter surface of the sheets caused during the stress-relief annealing, and which enable a smooth lacing operation.

As for the technical means for improving the wound core fabricability of the sheet, improvements of coating materials for the formation of the insulating films have been made. For example, Japanese Laid-Open Patent Application Sho 61-4773 discloses the art of improving the lubricity of an insulating film formed on the sheet, which comprises coating a finally annealed steel sheet (strip) with a mixture liquid composed of phosphate, and containing at least one selected from the group consisting of super fine colloidal silica of a particle diameter not larger than 8 nano m, chromic acid and chromate, and baking the thus coated sheet.

In recent years, these improvements of the insulating film, indeed, have contributed to some extents for improvements of the iron loss, magnetostriction, insulating characteristics, and film lubricity of the grain-oriented silicon steel sheets.

However, on the side of manufactureres producing transformers and the like by using grain-oriented silicon steel sheets, automatization and speed-up of iron core making machines have been widely and rapidly adopted, and along these tendencies, demands are increasing for still more improvements than the aforementioned improvements of the insulating film, which can eliminate troubles in the wound core fabricating and can contribute for still more improved magnetic characteristics.

OBJECT AND SUMMARY OF THE INVENTION

The object of the present invention is to provide a method for forming an insulating film on a grain-oriented silicon steel sheet, which produces good surface film lubricity and good heat resistance during the stress-relief annealing, and assures excellent workability for winding into a wound core as well as an excellent iron loss property by improved tension of the insulating film, and to provide a grain-oriented silicon steel sheet having such improved insulating film.

The present invention is directed to a method for producing a grain-oriented silicon steel sheet, which comprises hot rolling a silicon steel slab, annealing the hot rolled sheet, cold rolling the annealed sheet one time or two times with an intermediate annealing performed therebetween to the final gauge, subjecting the sheet to a decarburization annealing, coating the sheet with an annealing separator, subjecting the sheet to a final annealing and, after application of an insulating coating solution, subjecting the sheet to baking and heat flattening, and the present invention provides improvements that the insulating coating solution comprises:

100 parts by weight (calculated as the solid component) of a mixture of colloidal substances, composed of 50 to 98 weight % (calculated as the solid component $SiO_2$) of colloidal silica having a particle diameter not larger than 50 nano m, and 2 to 50 weight % (calculated as the solid component) of at least one colloidal substance having a particle diameter ranging from 80 to 3000 nano m, selected from the group consisting of oxides, carbides, nitrides, sulfides, borides, hydroxides, silicates, carbonates, borates, sulfates, nitrates and chlorides of Fe, Ca, Ba, Zn, Al, Ni, Sn, Cu, Cr, Cd, Nd, Mn, Mo, Si, Ti, W, Bi, Sr, and V, 130 to 250 parts by weight of at least one selected from the group consisting of phosphates of Al, Mg, Ca, and Zn, and 10 to 40 parts by weight of at least one selected from the group consisting of chromic anhydride, chromate, and dichromate and that the surface roughness of the steel sheet after the formation of the insulating film is in the range from 0.15 to 0.60 $\mu$m in the term of Ra value.

BRIEF DESCRIPTION OF THE DRAWINGS

FIG. 1 shows a method (Method A) for measuring the friction coefficients of the insulating film.

FIG. 2(*a*) shows the laminated sample sheets in the annealing for measuring the adhesion during the stress-relief annealing.

FIG. 2(*b*) shows schematically a manner for measuring the inter-layer adhesion between the laminated sheets after the stress-relief annealing.

DETAILED DESCRIPTION OF THE INVENTION

Figure 3:
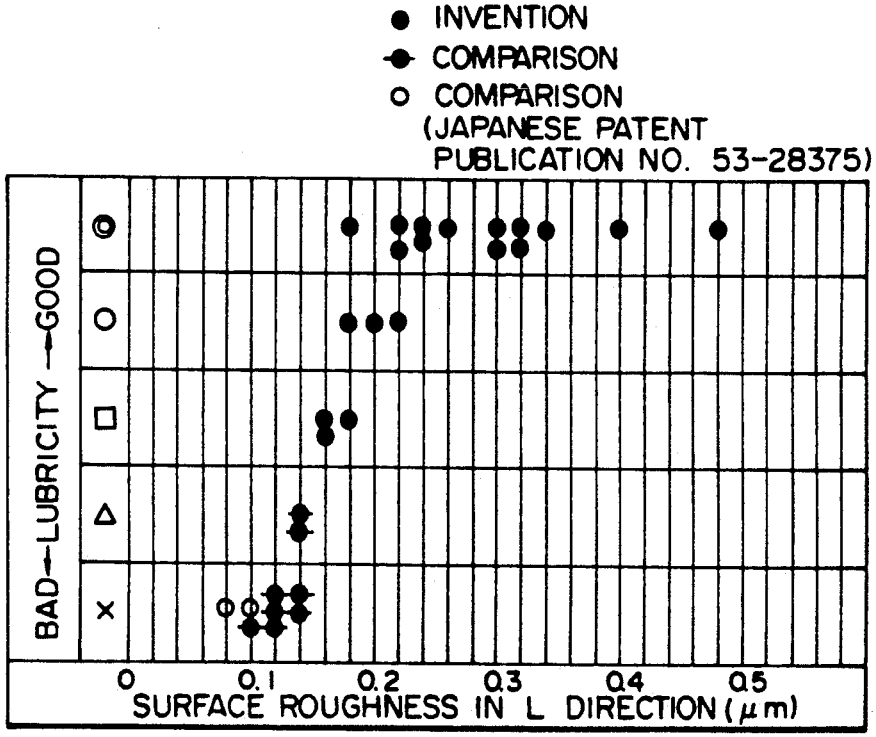
FIG. 3 shows the relation between the surface configuration and the lubricity of the products obtained according to the present invention.

The present invention will be described in more details hereinbelow.

The present inventors conducted extensive studies and experiments for forming an insulating film on a grain-oriented silicon steel sheet which can solve the techical problems mentioned hereinbefore and found that addition of the colloidal substance having a particle diameter ranging from 80 to 3000 nano m to the basic insulating coating solution comprising colloidal silica, a phosphate and a chromium compound can remarkably improve the lubricity of the insulating film formed on the sheet by the baking treatment, can considerably ameliorate the softening and chemical reaction of surface-layer called "adhesion" caused during the stress-relief annealing, and improve the iron loss property.

Hereinbelow the present invention will be described in more details referring to the experimental data.

A coil of grain-oriented silicon steel sheet of 0.23 mm thick was produced by a conventionally known art and sample sheets were taken from the coil after a final finishing annealing. These sample sheets were subjected to a stress-relief annealing in $N_2$ gas at 850° C. for 4 hours, then decoiled, and subjected to light pickling with 2% $H_2SO_4$ at 80° C. for 10 seconds to prepare starting test sheets. On these sample sheets, an insulating coating solution containing a colloidal substance of oxides of Cr, V, and Si having a particle diameter ranging from 80 to 3000 nano m as shown in Table 1 was applied in a calculated amount to give 4.5 g/m$^2$ coating after the baking, and the thus coated sheets were subjected to the baking treatment at 850° C. for 30 seconds.

The test pieces taken from the final product sheets were measured for friction coefficients $\mu$ of the insulating films by the method (Method A) shown in FIG. 1, in which the test piece 2 was placed between the holding sheets 1-1, and 1-2, and loaded by the weight 3, the force F′ required for drawing out the test piece 2 was measured by the spring counter 4 and the friction coefficient (FF) was calculated from $\mu = F'/P$.

Further, the lubricity of the surface film was measured by the method B, in which a steel ball given a predetermined load was slided on the insulating film without rolling and the resistance which the steel ball received was continuously measured electrically.

Also test sheets of 3 cm×4 cm separately taken from the same sample stock were laminated and bound together with a force of 60 kg/cm$^2$ and subjected to a stress-relief annealing at 850° C. for 4 hours to measure the stripping load of the sheets and to investigate the adhesion of the sheets. The results are shown in Table 1.

TABLE 1

Insulating Coating Solution and Surface Qualities of Product Sheets

| Test No | Basic Insulating Coating Composition: 20% Colloidal Silica | Basic Insulating Coating Composition: 50% Aluminum Phosphate | Basic Insulating Coating Composition: $CrO_3$ | Additional Colloidal Solution: Kinds | Additional Colloidal Solution: Particle Diameter | Additional Colloidal Solution: Addition Amount | Film Lubricity: FF Value (Method A) | Film Lubricity: Lubricity (Method B) | Film Tension (kg/mm$^2$) | Adhesion Level (g/9 cm$^2$) |
|---|---|---|---|---|---|---|---|---|---|---|
| 1 | (particle diameter 10 nano m) 85 cc | 50 cc | 7 g | $V_2O_5$ | 80 nano m | 15 cc | 0.50 | ○ | 0.53 | 130 |
| 2 | (particle diameter 10 nana m) 85 cc | " | " | " | 500 nano m | " | 0.43 | ○ | 0.60 | 40 |
| 3 | (particle diameter 10 nana m) 85 cc | " | " | " | 3,000 nano m | " | 0.52 | ○ | 0.57 | 10 |
| 4 | (particle diameter 10 nano m) 85 cc | " | " | $SiO_2$ | 80 nano m | " | 0.51 | ○ | 0.55 | 80 |
| 5 | (particle diameter 10 nano m) 85 cc | " | " | " | 500 nano m | " | 0.28 | ○ | 0.59 | 30 |
| 6 | (particle diameter 10 nano m) 85 cc | " | " | " | 3,000 nano m | " | 0.46 | ○ | 0.48 | 0 |
| 7 | (particle diameter 10 nano m) 85 cc | " | " | $Cr_2O_3$ | 80 nano m | " | 0.49 | ○ | 0.55 | 110 |
| 8 | (particle diameter 10 nano m) 85 cc | " | " | " | 500 nano m | " | 0.33 | ○ | 0.61 | 60 |
| 9 | (particle diameter 10 nano m) 85 cc | " | " | " | 3,000 nano m | " | 0.50 | ○ | 0.53 | 30 |
| Comparison | 100 cc | " | " | — | — | — | 0.73 | X | 0.42 | 390 |

Note: Comparison (Japanese Patent Publication Sho 53-28375)

As shown in Table 1, the insulating films formed by baking the insulating coating solution containing the colloidal solution of additional substances having a particle diameter ranging from 80 to 3000 nano m according to the present invention show remarkable improvements with respect to all of the film lubricity, the film tension, and the adhesion level in the stress-relief annealing, as compared with the conventional insulating film formed by the insulating coating composition composed only of the colloidal silica having a particle diameter of 10 nano m.

The insulating coating solution according to the present invention will be described in details hereinbelow.

The insulating coating solution according to the present invention comprises:

100 parts by weight (calculated as the solid component) of a mixture of colloidal substances, composed of 50 to 98 weight % (calculated as the solid component $SiO_2$) of colloidal silica having a partical diameter not larger than 50 nano m, and 2 to 50 weight % (calculated as the solid component) of at least one colloidal substance having a particle diameter ranging from 80 to 3000 nano m, selected from the group consisting of oxides, carbides, nitrides, sulfides, borides, hydroxides, silicates, carbonates, borates, sulfates, nitrates and chlorides of Fe, Ca, Ba, Zn, Al, Ni, Sn, Cu, Cr, Cd, Nd, Mn, Mo, Si, Ti, W, Bi, Sr, and V, 130 to 250 parts by weight of at least one selected from the group consisting of phosphates of Al, Mg, Ca, and Zn, and 10 to 40 parts by weight of at least one selected from the group consisting of chromic anhydride, chromate, and dichromate.

For the practice of the present invention, the mixture of colloidal silica and additional colloidal substances as defined above may be prepared by mixing colloidal silica having different particle diameters within the above defined range with one or more kinds of additional colloidal substances having different paricle diameters within the above defined range, or may be prepared by mixing colloidal silica having the same particle diameter within the above defined range with one or more of additional colloidal substances having the same particle diameter within the above defined range.

The reasons for various limitations defined in the present invention will be explained herein below.

For preparation of the insulating coating solution according to the present invention, 130 to 250 parts by weight of at least one selected from the group consisting of phophates of Al, Mg, Ca, and Zn and 10 to 40 parts by weight of at least one selected from the group consisting of chromic anhydrides, chromate and dichromates are admixed with 100 parts by weight of the mixture solution of colloidal silica and additional colloidal substacnes, containing 50 to 98 weight % (calculated as the solid component $SiO_2$) of colloidal silica having a particle diameter not larger than 50 nano m and 2 to 50 weight % (calculated as the solid component) of the additional colloidal substances.

The most important feature of the present invention lies in that 2 to 50 weight % of the additional colloidal substances having a coarse particle diameter as 80 to 3000 nano m is admixed to 50 to 98 weight % of the colloidal silica having a fine particle diameter as not larger than 50 nano m, and that to 100 parts by weight of this mixture the additives as defined above are added to obtain the insulating coating solution to be applied on the surface of the silicon steel sheet.

With the addition of 2 to 50 weight % of additional colloidal substances having a particle diameter ranging from 80 to 3000 nano m to 50 to 98 weight % of colloidal silica (calculated as solid component $SiO_2$) having a particle diameter not larger than 50 nano m, the resultant insulating film formed on the silicon steel sheet shows remarkable improvements of the film lubricity, the adhesion level during the stress-relief annealing, the film tension and so on.

It is important that the colloidal silica constituting the base of the insulating coating solution has a particle diameter not larger than 50 nano m. With a particle diameter larger than 50 nano m, the improvements of the iron loss and the magnetostriction which are basic properties of the insulating film are subdued or the resultant film becomes whitish, thus deteriorating the surface appearance.

The coarse colloidal substance to be added to the super fine colloidal silica is selected from the group consisting of oxides, carbides, nitrides, sulfides, borides, hydroxides, silicates, carbonates, borates, sulfates, nitrates, and chlorides of Fe, Ca, Ba, Zn, Al, Ni, Sn, Cu, Cr, Cd, Nd, Mn, Mo, Si, Ti, W, Bi, Sr, and V, having a particle diameter ranging from 80 to 3000 nano m. If the particle diameter is smaller than 80 nano m, the resultant improvement effects on the lubricity and adhesion level properties are not satisfactory, while the particle diameter exceeding 3000 nano m is not desirable, because it lowers the space factor of the final products, hence lowering the iron loss property, though the lubricity and adhesion level properties are improved.

Although any of the above mentioned additional colloidal substances may be added, the oxides, carbides, nitrides, and sulfides are most preferable from the view point of the stability of the insulating coating solution where the colloidal silica, the phosphate, and chromium compound are mixed. As for the shape of the colloidal substances any of spherical shape, net-work shape, chain shape, and planar shape may be used, but the spherical shape is most preferable.

For stabilization of the colloidal solution, a fine amount of other stabilizing agents may be added.

The proportion of the phosphate to the mixture of the colloidal silica and the additional colloidal substance is 130 to 250 parts by weight of at least one of phosphates of Al, Mg, Ca, and Zn to 100 parts by weight of the mixture. This proportion is important from the points of the tension given by the insulating film and the heat resistance of the film. If the proportion of the phosphate is less than 130 parts to 100 parts of the mixture, the formed insulating film will crack due to the shortness of the binder relative to the colloidal silica, thus losing the tension effect of the film. On the other hand, if the proportion exceeds 250 parts, the formed film will be whitish, the film tension effect will be lowered, and moreover the heat resistance during the stress-relief annealing will be sharply deteriorated. For these reasons, the upper limit of the phosphate addition is set at 250 parts.

As the phosphates, one or more of phosphates of Al, Mg, Ca, Zn are used, and commercially available 50% phosphate solution may be used. However, calcium phosphate has a low solubility and is not available as 50% solution. Therefore, calcium phosphate in the solid from may be used.

For the purpose of improving the lubricity of the insulating film, the most preferably combination of the phosphates is Al-Mg-Ca, Al-Ca, or Mg-Ca.

The proportion of chromium compound to the mixture of the colloidal silica and the additional colloidal substance is 10 to 40 parts by weight of at least one of chromic anhydride, chromate, and dichromate to 100 parts by weight of the mixture. If the proportion of the chromium compound is less than 10 parts by weight, it is not enough to stabilize to free phosphoric acid in the film composition through reactions such as formation of $CrPO_4$ so that the resultant film becomes sticky. On the other hand, if the proporation exceeds 40 parts by weight, the free chromic acid becomes excessive and the film becomes sticky also.

In the present invention, the additional colloidal substances other than the colloidal silica may be prepared in their preparation stage so as to have an appropriate particle diameter distribution, or fine grades and corase grades of the colloidal silica and the additional colloidal substacnes are separately prepared and more than two of these grades are mixed to obtain the combination of the particle diameters defined in the present invention.

The surface roughness of the steel sheets after the formation of the insulating film thereon in the way as described above is in the range from 0.15 to 0.60 μm in Ra. If the Ra value is lower than 0.15 μm the lubricity improving effect lowers, and on the other hand if the Ra value is beyond 0.60 μm, the space factor at the time of laminating the steel sheets lowers. With the insulating film composition according to the present invention, the Ra value can be controlled in the above optimum range.

Hereinbelow, the reasons why the insulating film formed by the present invention shows excellent lubricity and heat resistance will be explained.

As for the mechanism of improving the lubricity of the sheet surface, the following three factors are considered:

1) basically the film surface is smooth,
2) the film itself has a good lubricity, and
3) the film is a point-contact type of surface configuration.

The art disclosd by the present inventors in Japanese Laid-Open Patent Application Sho 61-4773 is based on the factor 1) above, while the present invention relies more on the factor 3) of the point contact effect due to the surface configuration. Thus in the present invention, the additional colloidal substances of coarse particles added to the colloidal silica of fine particles will give the surface a smooth slipping mechanism realized by the fine spherical configuration formed on the surface, and further during the stress-relief annealing of the iron cores, the fine spherical configuration contributes greatly to reduce the contact area between the sheets, thus improving the adhesion level.

Regarding the improvement of the iron loss value achieved by the present invention, the reason for the improvement is still to be theoretically clarified, but is assumed that when the coarse particles of the additional colloidal substances are admixed to the fine particles of the colloidal silica, the tendency of the colloids that the fine particles adsorb on the surface of the coarse particles is accelerated during the baking step to produce new strains, which enhance the tension effect.

In FIG. 3, the relation between the surface configuration of the sheet products produced according to the present invention and the lubricity (B method) is shown. The sheet products having the Ra value of 0.15 μm produced by the present invention show remarkably improved lubricity.

Figure 4A:
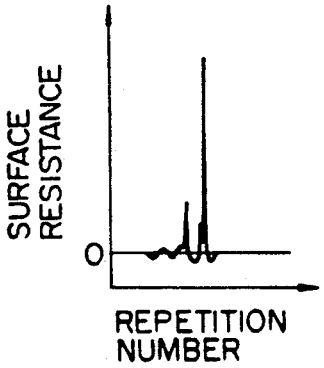
FIG. 4 shows the relation between the composition of the insulating film coating (Table 6) and the lubricity (Method B) of the surface of the product obtained according to the present invention.
Figure 4B:
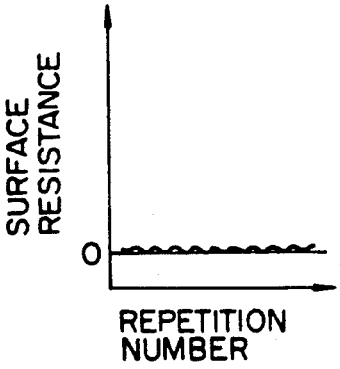
Figure 4C:
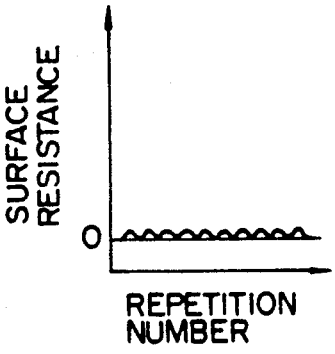

In FIG. 4 the relation between the insulating film composition (Table 6) and the lubricity of the sheet product surface (B method) is shown. In the case of the comparison (a), a remarkably high surface resistance is observed by two or three repeated measurements, while in the cases of the compositions (a) and (b) according to the present invention, no changes are observed by the repeated measurements and only a low surface resistance is observed.

DESCRIPTION OF PREFERRED EMBODIMENTS

The present invention will be better understood from the following description of the preferred embodiments

EXAMPLE 1

A steel slab containing by weight 0.076% C, 3.30% Si, 0.068% Mn, 0.024% S, 0.030% sol. Al, with the balance being iron and unavoidable impurities was hot rolled by a conventional method, and after annealing, cold rolled to a final thickness of 0.29 mm. This cold rolled sheet was subjected to the decarburization annealing, and after application of the annealing separator, subjected to the final finishing annealing to form a forsterite film on the sheet surface.

Then the excessive annealing separator was removed by scrubbing from the sheet and after pickling with diluted sulfuric acid, the sheet was coated with the insulating coating solution admixed with various colloidal solutions containing particles of 200 nano m diameter as shown in Table 2 in an amount which gives 4.5 $g/m^2$ of the coating after baking, and subjected to the baking treatment at 850° C. for 30 seconds in an $N_2$ atmosphere. In this example, as the colloidal silica which constitutes the base of the coating composition, a commercially available aqueous solution of 10 nano m diameter was used.

After the baking treatment, samples were taken out from the baked sheets to evaluate the surface roughness, the surface lubricity, the film tension, and the adhesion property during the stress-relief annealing etc. The results are shown in Table 3.

TABLE 2

| | Insulating Coating Solution | | | | |
|---|---|---|---|---|---|
| | Basic Composition | | | Additives | |
| | 20% Colloidal Silica (Particle diameter 10 nano m) | 50% Aluminum Phosphate | Chromium Compounds | Kinds of 20% Colloidal Solution | Amounts Added |
| 1 | 80 ml | 55 ml | $CrO_3$ 5 g | $SnO_2$ | 20 ml |
| 2 | " | " | $CrO_3$ 5 g | $MnO_2$ | " |
| 3 | " | " | $CrO_3$ 5 g | CaO | " |

TABLE 2-continued

| | Insulating Coating Solution | | | | |
|---|---|---|---|---|---|
| | Basic Composition | | | Additives | |
| | 20% Colloidal Silica (Particle diameter 10 nano m) | 50% Aluminum Phosphate | Chromium Compounds | Kinds of 20% Colloidal Solution | Amounts Added |
| 4 | " | " | $MgCrO_4$ 7 g | BN | " |
| 5 | " | " | $MgCrO_4$ 7 g | MnS | " |
| 6 | " | " | $MgCrO_4$ 7 g | $W_3C$ | " |
| 7 | " | " | $CaCr_2O_7$ 6 g | $BaCO_3$ | " |
| 8 | " | " | $CaCr_2O_7$ 6 g | MnS | " |
| 9 | " | " | $CaCr_2O_7$ 6 g | $NiSO_4 + CuCl_2$ (1:1) | " |
| 10 | " | " | $CrO_3$ 7 g | $MoS_2 + MgB_4O_7$ (1:1) | " |
| 11 | " | " | $CrO_3$ 7 g | $ZrO + SiO_2$ (1:1) | " |
| 12 | " | " | $CrO_3$ 7 g | AlN + FeS | " |
| 13 | " | " | $CrO_3$ 7 g | $Ca_2SiO_4 + Sr(NO_3)_2$ | " |
| Comparison | 100 ml | " | $CrO_3$ 7 g | — | — |

TABLE 3

| | Insulating Film Qualities of Product Sheets | | | | | | |
|---|---|---|---|---|---|---|---|
| | Surface Roughness | Lubricity | | | Iron Loss Value $W_{17/50}$ (W/kg) | | Adhesion |
| | Ra Value (μm) | Method A (Bauden Type) | Method B (FF Value) | Film Tension (kg/mm²) | Before Coating | After Coating | Level (g/9 cm²) |
| 1 | 0.28 | ◯ | 0.42 | 0.62 | 1.04 | 0.99 | 60 |
| 2 | 0.28 | ◯ | 0.40 | 0.57 | 1.05 | 0.99 | 55 |
| 3 | 0.29 | ◯ | 0.42 | 0.60 | 1.05 | 1.00 | 54 |
| 4 | 0.28 | ◯ | 0.40 | 0.52 | 1.04 | 0.99 | 48 |
| 5 | 0.25 | ◯ | 0.46 | 0.49 | 1.03 | 0.98 | 50 |
| 6 | 0.31 | ◯ | 0.35 | 0.64 | 1.04 | 0.99 | 63 |
| 7 | 0.29 | ◯ | 0.40 | 0.60 | 1.04 | 0.99 | 40 |
| 8 | 0.28 | ◯ | 0.40 | 0.53 | 1.05 | 1.01 | 60 |
| 9 | 0.33 | ◯ | 0.43 | 0.54 | 1.05 | 1.01 | 68 |
| 10 | 0.26 | ◯ | 0.41 | 0.66 | 1.04 | 0.98 | 45 |
| 11 | 0.28 | ◯ | 0.40 | 0.63 | 1.05 | 0.99 | 40 |
| 12 | 0.31 | ◯ | 0.39 | 0.57 | 1.03 | 1.99 | 35 |
| 13 | 0.26 | ◯ | 0.40 | 0.56 | 1.05 | 1.00 | 50 |
| Comparison | 0.12 | X | 0.76 | 0.48 | 1.05 | 1.02 | 360 |

Note: Comparison (Japanese Patent Publication Sho 53-28375)
Note (1) Evaluation of the lubricity (Method A)
◯ Very good: there is no occurrence of surface defects
◯ Good: there is slight occurrence of surface defects
Δ Slightly bad: there is slightly high occurrence of surface defects
X Bad: there is greatly high occurrence of surface defects Note (2) The adhesion level was evaluated by the stripping load for stripping the sheets after the stress-relief annealing (at 850° C. for 2 hours in $N_2$: under clamping pressure of 60 kg/cm²).

All of the sheet products produced according to the present invention show a greatly improved lubricity and adhesion level, as well as an improved film tension and satisfactory iron loss. Example 2

In the same manner as in Example 1, a cold rolled sheet of final thickness of 0.22 mm was prepared and subjected to the final finishing annealing to form the forsterite film on the sheet surface.

After the light picking in diluted sulfuric acid, the insulating coating solutions shown in Table 4 were applied on the sheets in an amount which gave 4.5 g/m² of the coating after baking. In this example, the insulating coating solutions were prepared with various phosphate proprotions in the basic coating solutions and with various particle diameters of the additional colloidal substances to be added to the colloidal silica of 15 nano m particle diameter.

After the baking treatment, samples were taken out from the sheets thus produced to evaluate the lubricity, the adhesion level and the iron loss. The results are shown in Table 5.

In this example, too, all of the sheets produced according to the present invention show remarkably improved lubricity and adhesion level, as well as satisfactory iron loss as obtained in Example 1.

TABLE 4

| | Insulating Coating Solution | | | | | |
|---|---|---|---|---|---|---|
| | Basic Composition | | | Additional Colloids (20% solution) | | |
| | 20% Colloidal Silica (Particle diameter 15 nano m) | 50% Phosphate | Chromium Compounds | Kind of 20% colloidal solution | Particle Diameter | Amounts Added |
| 1 | 70 ml | $Al(H_2PO_4)_3$ 50 ml | $CrO_3$ 6 g | $Cr_2O_3$ | 80 nano m | 30 ml |
| 2 | " | $Al(H_2PO_4)_3$ 50 ml | $CrO_3$ 6 g | " | 200 nano m | " |
| 3 | " | $Al(H_2PO_4)_3$ 50 ml | $CrO_3$ 6 g | " | 1000 nano m | " |
| 4 | " | $Al(H_2PO_4)_3$ 50 ml | $CrO_3$ 6 g | " | 3000 nano m | " |
| 5 | 70 ml | $Al(H_2PO_4)_3$ 20 ml | $MgCr_2O_7$ 10 g | TiN | 80 nano m | 30 ml |
| 6 | " | $Mg(H_2PO_4)_2$ 30 ml | $MgCr_2O_7$ 10 g | " | 200 nano m | " |
| 7 | " | $Mg(H_2PO_4)_2$ 30 ml | $MgCr_2O_7$ 10 g | " | 1000 nano m | " |
| 8 | " | $Mg(H_2PO_4)_2$ 30 ml | $MgCr_2O_7$ 10 g | " | 3000 nano m | " |
| 9 | 95 ml | $Al(H_2PO_4)_3$ 20 ml | $CaCr_2O_7$ 5 g | $MoS_2$ | 300 nano m | 5 ml |
| 10 | 90 ml | $Mg(H_2PO_4)_2$ 20 ml | $CrO_3$ 5 g | " | " | 10 ml |
| 11 | 80 ml | $Ca(H_2PO_4)_2$ 10 ml | | " | " | 20 ml |
| 12 | 50 ml | $Ca(H_2PO_4)_2$ 10 ml | | " | " | 50 ml |
| 13 | 95 ml | $Ca(H_2PO_4)_2$ 10 ml | $CrO_3$ 6 g | $Ni_2O_3$ | 300 nano m | 5 ml |
| 14 | 90 ml | $Ca(H_2PO_4)_2$ 10 ml | $CrO_3$ 6 g | " | " | 10 ml |
| 15 | 80 ml | $Ca(H_2PO_4)_2$ 10 ml | $CrO_3$ 6 g | " | " | 20 ml |
| 16 | 50 ml | $Ca(H_2PO_4)_2$ 10 ml | $CrO_3$ 6 g | " | " | 50 ml |
| Comparison (Japanese Patent Publication Sho 53-28375) | 100 ml | $Al(H_2PO_4)_3$ 50 ml | $CrO_3$ 6 g | — | — | — |

TABLE 5

| | Insulating Film Qualities of Product Sheets | | | | | |
|---|---|---|---|---|---|---|
| | Sheet Surface | Lubricity Characteristics | | Iron Loss Value $W_{17/50}$ (W/kg) | | Adhesion |
| | Roughness Ra (μm) | FF Value (Method A) | Lubricity (Method B) | Before Coating | After Coating | Level g/9 cm² |
| 1 | 0.17 | 0.45 | ○ | 0.90 | 0.82 | 160 |
| 2 | 0.26 | 0.28 | ○ | 0.88 | 0.81 | 30 |
| 3 | 0.40 | 0.33 | ○ | 0.89 | 0.82 | 10 |
| 4 | 0.55 | 0.40 | ○ | 0.88 | 0.82 | 0 |
| 5 | 0.16 | 0.48 | ○ | 0.87 | 0.81 | 120 |
| 6 | 0.24 | 0.30 | ○ | 0.91 | 0.82 | 50 |
| 7 | 0.43 | 0.35 | ○ | 0.88 | 0.80 | 0 |
| 8 | 0.58 | 0.50 | ○ | 0.90 | 0.83 | 0 |
| 9 | 0.20 | 0.41 | ○ | 0.90 | 0.83 | 140 |
| 10 | 0.26 | 0.30 | ○ | 0.87 | 0.80 | 50 |
| 11 | 0.33 | 0.32 | ○ | 0.87 | 0.80 | 40 |
| 12 | 0.48 | 0.48 | ○ | 0.89 | 0.83 | 20 |
| 13 | 0.20 | 0.42 | ○ | 0.89 | 0.82 | 150 |
| 14 | 0.28 | 0.29 | ○ | 0.89 | 0.82 | 40 |
| 15 | 0.36 | 0.30 | ○ | 0.86 | 0.80 | 30 |
| 16 | 0.51 | 0.36 | ○ | 0.88 | 0.87 | 0 |
| Comparison (Japanese Patent Pablication Sho 53-28375) | 0.12 | 0.72 | X | 0.90 | 0.85 | 400 |

TABLE 6

| Comparisons | Invention (a) | Invention (b) |
|---|---|---|
| 50% $Al(H_2PO_4)_3$ 50 ml | 50% $Al(H_2PO_4)_3$ 50 ml | 50% $Mg(H_2PO_4)_2$ 25 ml |
| 20% Colloidal Silica 100 ml (particle diameter 10 nano m) | 20% Colloidal Silica 80 ml (Particle diameter 10 nano m) | 50% $AL(H_2PO_4)_3$ 25 ml |
| $CrO_3$ 5 g | 20% Colloidal $SnO_2$ 20 ml (Particle diameter 300 nano m) | 20% Colloidal Silica 70 ml (Particle diameter 10 nano m) |
| | $CrO_3$ 5 g | 20% Colloidal Silica 10 ml (Particle diameter 500 nano m) |
| | | 20% Colloidal ZrO 20 ml |
| | | $CrO_3$ 5 g |

Note: Comparison (Japanese Patent Publication Sho 53-28375)

What is claimed is:

1. A method for producing a grain-oriented silicon steel sheet having an insulating film formed thereon, excellent workability when fabricating into a wound core and having excellent heat resistance, and film tension exertion, which comprises hot rolling a silicon steel slab, annealing the hot rolled steel sheet thus obtained, cold rolling the annealed sheet one time or two times with an intermediate annealing performed therebetween to the final gauge, subjecting the sheet thus cold rolled to decarburization annealing, coating the sheet with an annealing separator, subjecting the sheet to a final annealing, then applying an insulating coating solution on the surface of the sheet, and subsequently subjecting the sheet thus coated to baking and heat flattening to form an insulating film on the sheet, wherein said insulating coating solution comprises:

100 parts by weight, calculated as the solid component, of a mixture of colloidal substances, composed of 50 to 98 weight %, calculated as the solid component $SiO_2$, of colloidal silica having a particle diameter not larger than 50 nano m, and 2 to 50 weight %, calculated as the solid component, of at least one colloidal substance having a particle diameter ranging from 80 to 3000 nano m, selected from the group consisting of oxides, carbides, nitrides, sulfides, borides, hydroxides, silicates, carbonates, borates, sulfates, nitrates and chlorides of Fe, Ca, Ba, Zn, Al, Ni, Sn, Cu, Cr, Cd, Nd, Mn, Mo, Si, Ti, W, Bi, Sr, and V, 130 to 250 parts by weight of at least one phosphate selected from the group consisting of phosphates of Al, Mg, Ca, and Zn, and 10 to 40 parts by weight of at least one material selected from the group consisting of chromic anhydride, chromate, and dichromate.

2. A method according to claim 1, wherein said sheet after the formation of the insulating film has a surface roughness ranging from 0.15 to 0.60 μm in Ra.

* * * * *